US007857063B2

(12) United States Patent
Thornton

(10) Patent No.: US 7,857,063 B2
(45) Date of Patent: Dec. 28, 2010

(54) CENTRALISER

(76) Inventor: Thomas John Oliver Thornton, 17 St. Mary's Gardens, London, SE11 (GB)

( * ) Notice: Subject to any disclaimer, the term of this patent is extended or adjusted under 35 U.S.C. 154(b) by 88 days.

(21) Appl. No.: 11/480,522

(22) Filed: Jul. 5, 2006

(65) Prior Publication Data

US 2007/0007015 A1 Jan. 11, 2007

(30) Foreign Application Priority Data

Jul. 5, 2005 (GB) ..... 0513734.4

(51) Int. Cl.
*E21B 17/10* (2006.01)
*E21B 17/00* (2006.01)

(52) U.S. Cl. ..... 166/380; 166/207; 166/241.6

(58) Field of Classification Search ..... 166/380, 166/207, 241.1, 241.6, 241.7; 175/325.5
See application file for complete search history.

(56) References Cited

U.S. PATENT DOCUMENTS

| | | | | |
|---|---|---|---|---|
| 2,258,052 | A * | 10/1941 | Hall | 166/172 |
| 4,630,690 | A * | 12/1986 | Beasley et al. | 175/57 |
| 4,842,082 | A * | 6/1989 | Springer | 175/279 |
| 5,358,040 | A | 10/1994 | Kinley et al. | |
| 6,098,717 | A | 8/2000 | Bailey et al. | |
| 6,666,267 | B1 | 12/2003 | Charlton | |
| 6,997,254 | B2 * | 2/2006 | Jenner | 166/241.6 |
| 7,377,325 | B2 * | 5/2008 | Trinder et al. | 166/382 |
| 2002/0112853 | A1 * | 8/2002 | Buytaert | 166/241.6 |
| 2003/0164236 | A1 | 9/2003 | Thornton | |
| 2003/0230411 | A1 | 12/2003 | Richard | |
| 2004/0173349 | A1 * | 9/2004 | Pointing | 166/241.6 |
| 2004/0182571 | A1 * | 9/2004 | Betts | 166/241.6 |
| 2006/0266516 | A1 * | 11/2006 | Presslie et al. | 166/206 |

FOREIGN PATENT DOCUMENTS

| | | | |
|---|---|---|---|
| GB | 2 377 717 | A | 1/2003 |
| GB | 2381284 | A | 4/2003 |
| GB | 2403238 | A | 12/2004 |
| WO | WO 99/25949 | A2 | 5/1999 |
| WO | WO 02/02904 | A | 1/2002 |
| WO | WO 02/04781 | A1 | 1/2002 |
| WO | WO 03/001789 | A2 | 1/2003 |
| WO | WO 03/006789 | A1 | 1/2003 |
| WO | WO 03/012246 | A1 | 2/2003 |
| WO | WO 03/078781 | A1 | 9/2003 |
| WO | WO 03/078789 | A1 | 9/2003 |

* cited by examiner

*Primary Examiner*—William P Neuder
*Assistant Examiner*—Cathleen R Hutchins
(74) *Attorney, Agent, or Firm*—Fitch, Even, Tabin & Flannery

(57) ABSTRACT

There is disclosed an improved expandable centraliser (20; 120;220;320), which may optionally also be adjustable, and a related downhole assembly and a method of completing a well. Previous art has suffered from a number of problems and essentially attempted to mitigate the effect of pipe expansion, i.e. using tension caused in the centraliser body. The centraliser (20;120;220;320) of the invention uses the expansion of the tubing to cause compressive forces, which are exerted over known distances to energise blades of the centraliser by using relative motion caused by said expansion. The expandable centraliser (20;120;220;320) comprises at least one first member (30;130;230;330), and at least one second member (35;135;235;335), wherein, in use, relative circumferential motion of the at least one first and second members (30,35;130,135;230,235;330,335) causes radial motion of at least one portion (40;140;240;340) of the expandable centraliser (20;120;220;320).

42 Claims, 7 Drawing Sheets

CENTRALISER

This Application is a Non-Provisional Utility Patent Application which claims the foreign priority benefit from United Kingdom Application No. GB 0513734.4, filed Jul. 5, 2005, the complete disclosure of which is incorporated herein by reference.

FIELD OF INVENTION

The present invention relates to an improved centraliser for a downhole tubular, e.g. for use in an oil/gas well or a water well. The invention particularly, though not exclusively, relates to an expandable centraliser, which may optionally also be adjustable. The invention also concerns a related downhole assembly and a related method of completing a well.

BACKGROUND TO INVENTION

The use of expandable tubulars is becoming more common in the drilling and completion phases of well bore construction. U.S. Pat. No. 6,098,717 (BAILEY et al) discloses such an expandable tubular and also an expandable spacer.

Several designs of expandable centraliser have been described for use with expandable tubulars.

U.S. Pat. No. 5,358,040 (KINLEY et al) discloses a centraliser with mechanical roller arms which are limited in terms of extension. This centraliser is mechanically relatively complex, and liable to failure WO 03/006789 A1 (SHELL) discloses an expandable wellbore stabliser. Therein pre-energised arms are released upon expansion of a radially expandable tubular element, the arms thereafter being retained in place by action of a spring force. Although this stabliser is relatively simple, it suffers from a number of problems, e.g. if the arms are released prematurely the centraliser may become stuck downhole at an undesirable location.

WO 03/078789 A1 (DOWNHOLE PRODUCTS) discloses a slotted expandable centraliser adapted for use with slotted expandable casing.

The content of the prior art documents mentioned hereinbefore is incorporated herein by reference.

It is an object of at least one embodiment of at least one aspect of the present invention to obviate or mitigate one or more problems in the prior art.

It is also an object of at least one embodiment of at least one aspect of the present invention to provide an improved expandable centraliser which may be adjustable.

It is a further object of at least one embodiment of at least one aspect of the present invention to provide an improved expandable centraliser which instead of seeking to mitigate against tension, seeks to benefit from compression.

A concept behind at least one aspect of the present invention is as follows. Previous art has essentially attempted to mitigate the effect of the pipe expansion, i.e. using tension caused in the centraliser body. The centraliser of the invention uses the expansion of the tubing to cause compressive forces, which are exerted over known distances to energise blades of the centraliser by using relative motion caused by said expansion.

SUMMARY OF INVENTION

One or more objects of the present invention are sought to be addressed by providing a general solution of a centraliser wherein, in use, relative circumferential motion of a first part and a second part causes radial expansion of one of the first or second parts.

According to a first aspect of the present invention there is provided an expandable centraliser comprising at least one first member, and at least one second member, wherein, in use, relative circumferential motion of the at least one first and second members causes radial motion of at least one portion of the expandable centraliser.

The circumferential motion may be caused, in use, by radial expansion of the expandable centraliser, and the radial motion of the at least one portion may be radial expansion thereof.

In a first embodiment the or each at least one first member may comprise a finger or tongue, a distal end of which is fixed to the or a respective at least one second member.

In such an embodiment circumferential motion caused by radial expansion of a tubular causes the bush to be compressed or squeezed between the respective first and second members.

In a second embodiment the or each at least one first member may comprise a finger or tongue, and the or a respective at least second member may comprise a ramp, wedge, dog or the like.

In such an embodiment relative circumferential motion caused by radial expansion of a tubular causes the finger to ride over the wedge so causing the finger to move radially outwards.

In a third embodiment the at least one portion may comprise at least one elastomeric bush.

In such an embodiment circumferential motion caused by radial expansion of a tubular causes the bush to be compress or squeezed between the respective first and second members.

The bush may be made from a material selected from: a polymeric material, a plastics material, or beneficially a thermoplastic elastomer (TPE), e.g. a styrene block co-polymer, polyolefin blend, elastomeric alloys, thermoplastic polyurethane, thermoplastic polyamide.

The expandable centraliser may be suitably adjusted or "tuned" for a particular use by appropriate selection, e.g. of the length of the finger or tongue, or the size and/or compressibility of the bush, so as to provide a pre-selected radial expansion of the at least one portion.

Each at least one portion may, in use, act as a blade of the expandable centraliser touching the borehole (or tubular) within which the expandable tubular is to be centred.

The expandable centraliser may comprise a circular cross-section.

The expandable centraliser may be substantially annular or tubular in shape.

A plurality of first and second members and portions may be provided around a circumference of the expandable centraliser.

Radial contraction or removal of the expanded tubular may cause radial contraction of the or each at least one portion. In this way the expandable centraliser may be expandable and contractible.

The centraliser may be made from a metal or metallic based material, e.g. steel or from a polymer or plastics material, e.g. PEEK, PPA, PPS, PA, or a mixture of the two.

According to a second aspect of the present invention there is provided an expandable centraliser at least partly made from a polymeric material or plastic material.

The polymeric material or plastics material may be selected from a polymeric material, a plastic material, or beneficially a thermoplastic elastomer (TPE), e.g. a styrene block copolymer, polyolefin blend, elastomeric alloys, thermoplastic polyurethane, thermoplastic polyamide.

According to a third aspect of the present invention there is provided an expandable centraliser wherein, in use, radial expansion of the centraliser causes compression and/or circumferential movement of at least one portion of the centraliser so as to radially expand said at least one portion.

Said at least one portion may comprise a blade of the expandable centraliser.

Advantageously the centraliser of the first, second or third aspects of the present invention comprises or is adapted for use as a casing centraliser.

Alternatively, the centraliser of the first, second or third aspects of the present invention may comprise or may be adapted for use as a liner centraliser or as a screen centraliser.

Alternatively, the centraliser of the first, second or third aspects of the present invention may comprise or may be adapted for use as a production tubing centraliser.

According to a fourth aspect of the present invention there is provided a downhole assembly or apparatus comprising at least one expandable tubular and at least one expandable centraliser according to either of the first, second or third aspects of the present invention.

Preferably the assembly provides a plurality of expandable centralisers, e.g. longitudinally spaced along a length of the expandable tubular.

The at least one expandable tubular preferably comprises casing.

Alternatively, the at least one expandable tubular may comprise a liner, or a screen.

Alternatively, the at least one expandable tubular may comprise production tubing.

An explanation of the difference between casing, liners, screens and production tubing is given in WO 99/25949 (BRUNEL) and WO 02/02904 (BRUNEL), sharing common inventorship herewith, the content of which is incorporated herein by reference.

Preferably the at least one expandable centraliser is mounted on the at least one expandable tubular so as to circumferentially surround the expandable tubular.

According to a fifth aspect of the present invention there is provided a method of centralising an expandable tubular within a borehole comprising the step of:

providing at least one expandable tubular and at least one expandable centraliser, wherein the expandable centraliser comprises a centraliser according to either any of the first, second or third aspects of the present invention.

Preferably the method may comprise the further steps of:

mounting the expandable centraliser on the expandable tubular so as to provide an assembly;

placing the assembly in the borehole.

Preferably the method may comprise the yet further step of:

expanding the tubular, e.g. using a tubular expander either pushed down the tubular or pulled up the tubular, thereby causing expansion of the expandable tubular and expandable centraliser.

BRIEF DESCRIPTION OF DRAWINGS

Embodiments of the invention will now be described, by way of example only, and with reference to the accompanying drawings, which are.

DETAILED DESCRIPTION OF DRAWINGS

Figure 1A:
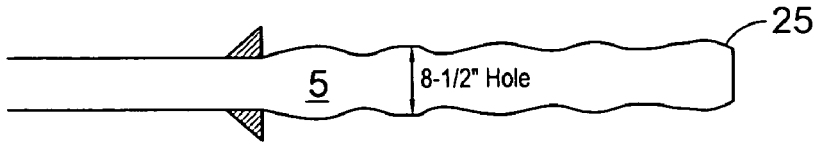
FIGS. 1(*a*) to (*e*) a series of schematic side cross-sectional views of a well bore including a downhole assembly comprising an expandable tubular and an expandable centraliser according to a first embodiment of the present invention.
Figure 1B:
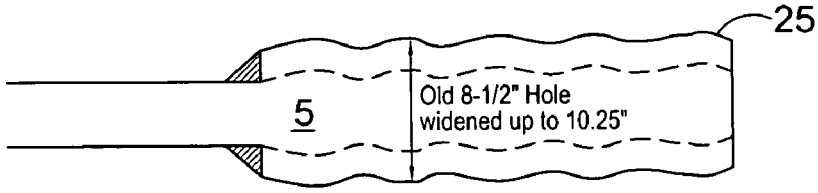
Figure 1C:
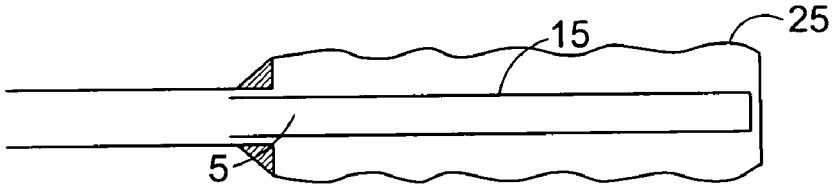
Figure 1D:
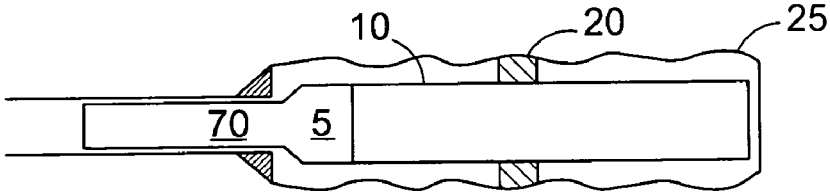
Figure 1E:
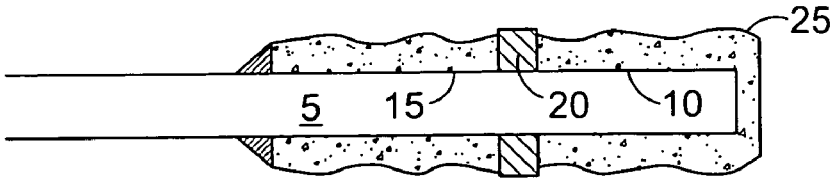
Figure 2A:
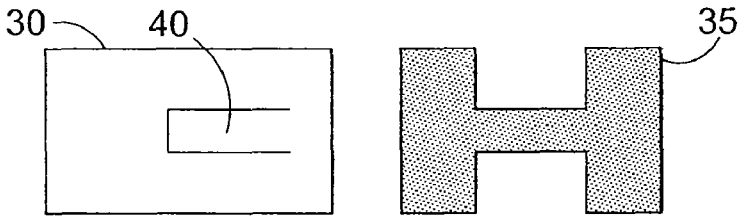
FIGS. 2(*a*) to (*e*) a series of schematic views showing a portion of the expandable centraliser of FIGS. 1(*a*) to (*e*)
Figure 2B:
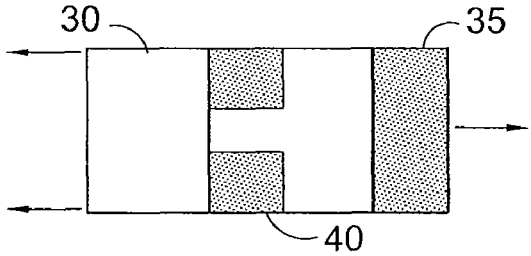
Figure 2C:
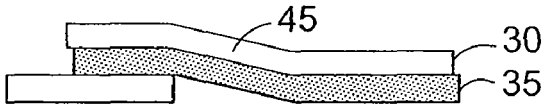
Figure 2D:
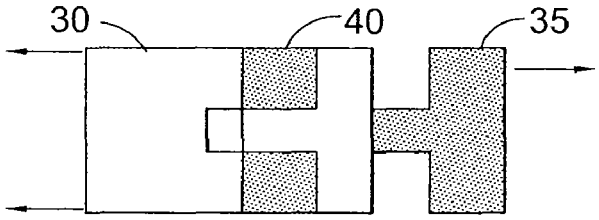
Figure 2E:
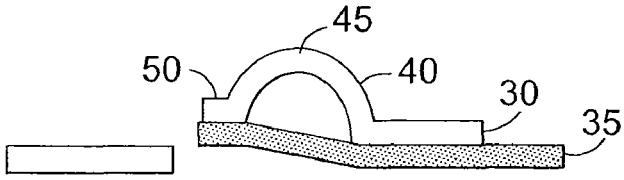
Figure 3A:
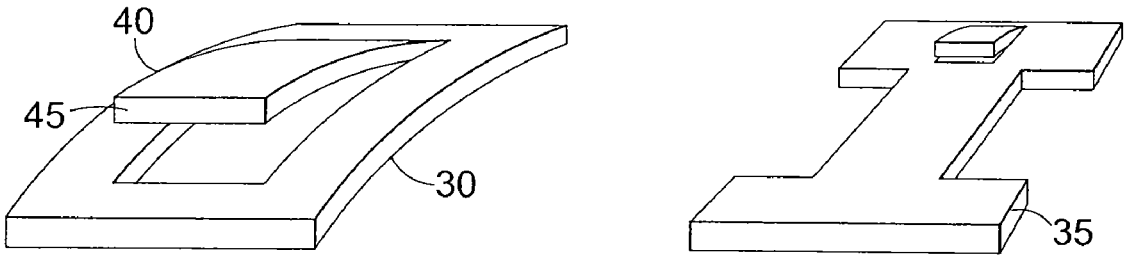
FIGS. 3(*a*) to (*c*) a series of schematic views showing a portion of the expandable centraliser of FIGS. 1(*a*) to (*e*)
Figure 3B:
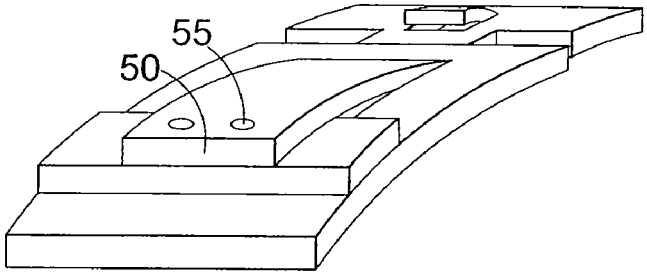
Figure 3C:
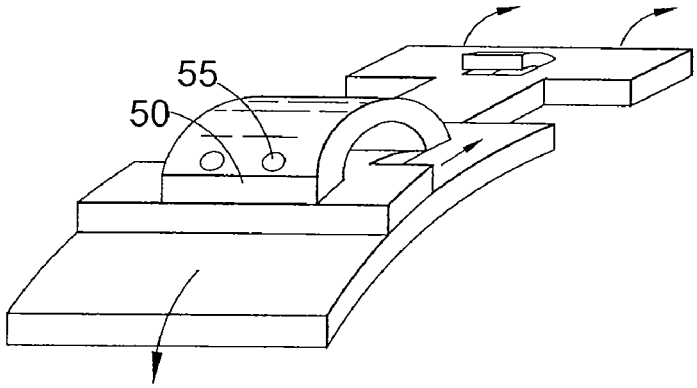

Referring initially to FIGS. 1(*a*) to (*e*) there are shown a series of schematic side cross-sectional views of a wellbore 5 including a downhole assembly 10 comprising an expandable tubular 15, and at least one expandable centraliser 20 according to a first embodiment of the present invention. In the present embodiment the expandable tubular 15 comprises casing used to case-off a rugous wall 25 of the wellbore 5.

The length of expandable tubular 15 can be run into a well when well bore problems have been encountered. A typical example would be when 9-⅝" casing has been set (drift diameter 8.535") and an 8.5" hole is being drilled. In the event that hole problems have been encountered, e.g. losses, collapsing hole, then it may be deemed prudent to "case" this troublesome zone off. In this event the existing hole of 8.5" is enlarged by use of an under-reamer, typically to a diameter of 10.25" and then an expandable tubular of Outer Diameter OD 7-⅝" is run into the well. The expandable tubular 15 is then expanded to 9.4" OD. It is then possible to cement the outside of this expandable tubular 15 to ensure no further communication can occur with the original borehole. It is known in the art that the process of cementing is best achieved by centralising the tubular 15 in the centre of the borehole 5, thus allowing an even distribution of cement around the tubular 15 or pipe body.

The centraliser 20 in the above example is subject to several constraints: e.g. the centraliser 20 needs to pass through a small Inner Diameter ID, e.g. 8.535", hole. The centraliser 20 then needs to be capable of being expanded, e.g. 7.625" to 9.40", and blades of the centraliser 20 need to give maximum stand-off at 10.25".

Referring now to FIGS. 2(*a*) to 3(*c*) there are shown views of a portion of the expandable centraliser 20 of FIGS. 1(*a*) to (*e*).

The expandable centraliser 20 comprises at least one first member 30, and at least one second member 35, wherein, in use, relative circumferential motion of the at least one first and second members 30,35 causes radial motion of at least one portion 40 of the expandable centraliser 20.

The circumferential motion is caused, in use, by radial expansion of the expandable centraliser 20, and the radial motion of the at least one portion 40 is radial expansion thereof.

In this first embodiment each at least one first member 30 comprises a finger 45, a distal end 50 of which is fixed to the or a respective at least one second member 35 by fixing means 55.

In such an embodiment relative circumferential motion caused by radial expansion of the tubular 15 causes the finger 45 to bend or bow radially outwards.

Referring to FIGS. 2(*a*) to 4(*c*) in this particular embodiment the centraliser 20 comprises a plurality of segments, e.g. four segments. Each segment comprises first member 30 comprising a lower band and second member 35 comprising an upper band. As the two bands are overlapped, the finger 45 or "blade" of the centraliser 20 is fixed to the lower band. This permits the centraliser 20 to be run in an almost flush arrangement with the smallest possible OD: a great advantage when running in crooked holes with doglegs present. When the tubular 15 or pipe body is expanded, the relative motion of the bands causes the finger 45 to become bent thus causing the tubular 15 to be lifted off the wall 25. As the amount of expansion of the finger 45 is known, (in the example of 7.625" pipe expanding to 9.390" pipe) a total of 5.55" (141 mm) of expansion occurs—35 mm per centraliser blade for a four finger or bladed unit. This expansion can be used to cause the degree of bend in the finger 45 to give desired stand-off—in this example a blade height of 11 mm is suitable. By altering the length of the finger 45 and thus the degree of "bend" caused to the finger 45 by the expansion process, it can been seen that the height of the finger 45 or blade can be adjustable. Substantially 100% centralisation in the hole 25 can be achieved by the setting mechanism, prior to the cement job being performed.

The centraliser 20 can be made from steel, with steel banding or the centraliser 20 could be made using a polymeric material, e.g. PEEK, PPS, PPA, PA. The finger 45 can be made from the same materials.

Figure 6A:
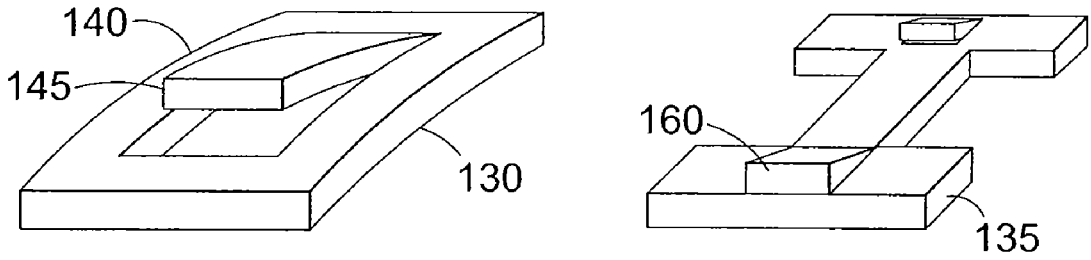
FIGS. 6(*a*) to (*c*) a series of schematic views showing a portion of an expandable centraliser according to a second embodiment of the present invention.
Figure 6B:
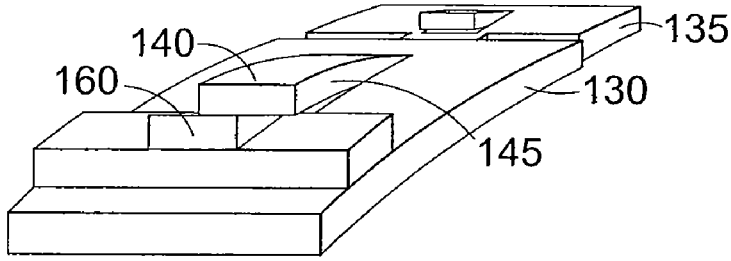
Figure 6C:
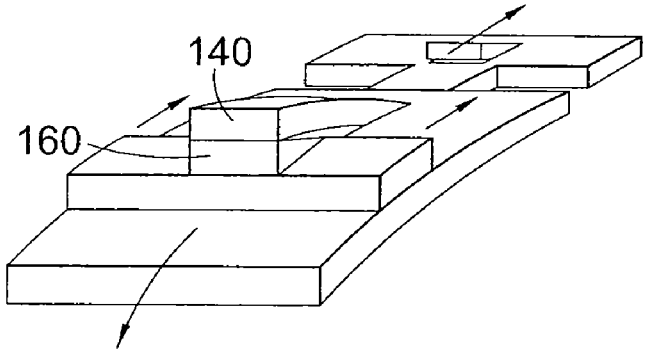

Referring briefly to FIGS. 6(*a*) to (*c*) there are shown views of a portion of an expandable centraliser 120 according to a second embodiment of the present invention. Like parts of the centraliser 120 are identified by the same integers as like parts of the centraliser of FIGS. 2(*a*) to 3(*c*), but increased by "100".

In this second embodiment each at least one first member 130 comprises a finger 145 and the respective at least one second member 135 comprises a ramp, wedge, dog 160 or the like.

In such an embodiment relative circumferential motion caused by radial expansion of the tubular 15 causes the finger 145 to ride over the wedge 160 so causing the finger 145 to move radially outwards.

In the second embodiment the compressive forces so described can be used to cause a blade to "lift" up causing the tubular 10 or pipe body to be lifted from the borehole wall 25 by a preset amount. The amount is adjustable via changing the angle of the wedged drive piece.

Figure 7A:
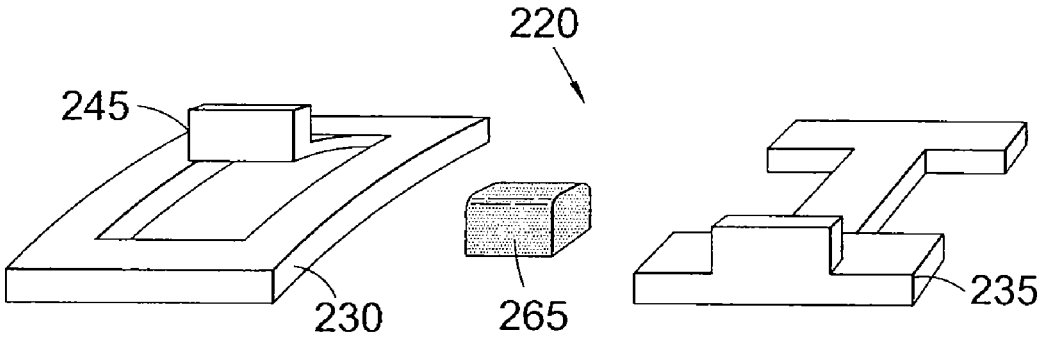
FIGS. 7(*a*) to (*c*) a series of schematic views showing a portion of an expandable centraliser according to a third embodiment of the present invention.
Figure 7B:
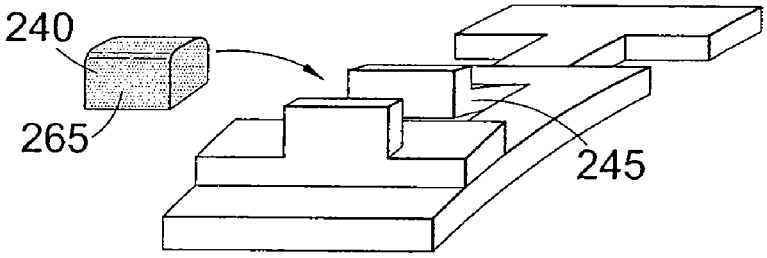
Figure 7C:
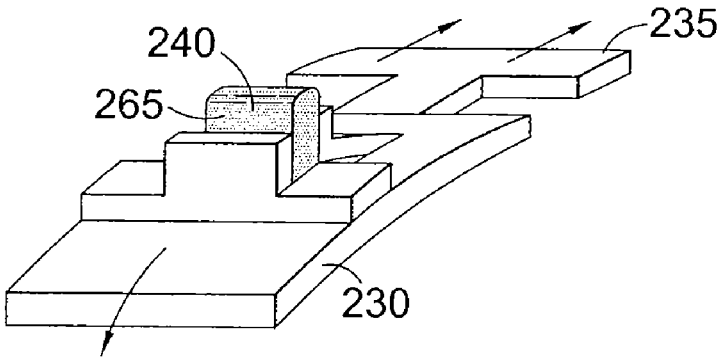

Referring briefly now to FIGS. 7(*a*) to (*c*) there are shown views of a portion of an expandable centraliser 220 according to a third embodiment of the present invention. Like parts of the centraliser 220 are identified by the same integers as like parts of the centraliser of FIGS. 2(*a*) to 3(*c*), but increased by "200".

In this third embodiment the at least one portion 240 comprises at least one elastomeric bush 265.

In such an embodiment circumferential motion caused by radial expansion of the tubular 15 causes the bush 265 to be compressed or squeezed between the respective first and second members 230,235.

The bush can be made from a material selected from: a polymeric material, a plastic material, or beneficially a thermoplastic elastomer (TPE), e.g. a styrene block copolymer, polyolefin blend, elastomeric alloys, thermoplastic polyurethane, thermoplastic polyamide.

The third embodiment can therefore use the compressive forces to compress a relatively ductile material, e.g. a polymeric material, causing a form of extrusion, again causing the tubular 10 or pipe body to be lifted from the borehole wall 25. The adjustment for the height of the extrusion is determined by the original dimensions of the polymeric material.

Figure 8A:
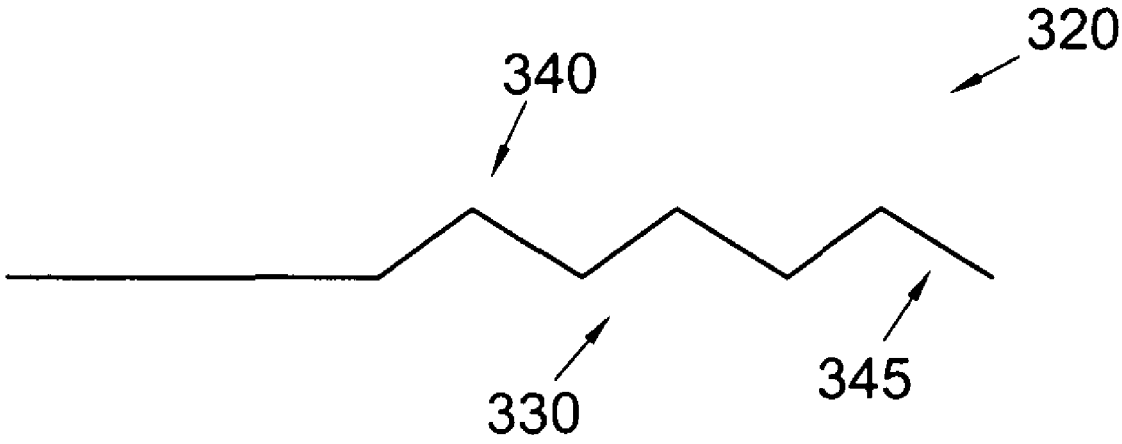
FIGS. 8(*a*) and (*b*) a series of schematic views showing a portion of an expandable centraliser according to a fourth embodiment of the present invention.
Figure 8B:
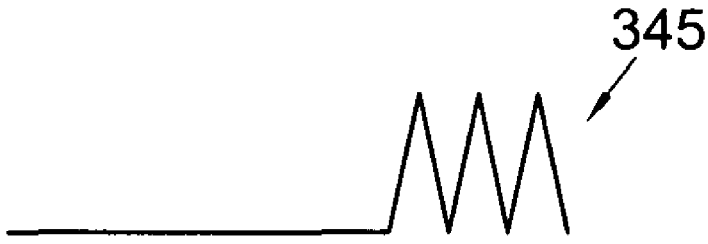

Referring now to FIGS. 8(*a*) and (*b*) there are shown views of a portion of an expandable centraliser 320 according to a fourth embodiment of the present invention Like parts of the centraliser 320 are identified by the same integers as like parts of the centraliser of FIGS. 2(*a*) to 3(*c*), but increased by "300".

In this fourth embodiment each at least one first member 330 comprises a corrugated or compressible finger 345. A distal end of the finger 345 may be joined to a second member (not shown) as in the first embodiment, or be free and "crushed" or "compressed" in use by a dog or abutting surface (not shown) as in the second and third embodiments.

It will therefore be appreciated that the "finger" can be a single "flat" piece of material (e.g. metal) that can be bent upwards, or a corrugated piece of material (e.g. metal) that when compressed, collapses together causing corrugations that were, e.g. at 45° to one another, to become substantially parallel to one another thus causing the finger to expand radially. Other finger designs may also be envisaged within the scope of the invention.

The expandable centralisers 20;120;220;320 are suitably adjusted or "tuned" for a particular use by appropriate selection, e.g. of the length of the finger 45;145;345 or the size and/or compressibility of the bush 265, so as to provide a pre-selected radial expansion of the at least one portion 40;140;240;340.

Each at least one portion 40;140;240;340 in use, act as a blade of the expandable centraliser 20;120;220;320 touching the borehole (or tubular) within which the expandable tubular 10 is to be centred.

The expandable centralisers 20;120;220;320 comprise a circular cross-section and are substantially annular or tubular in shape.

Figure 4A:
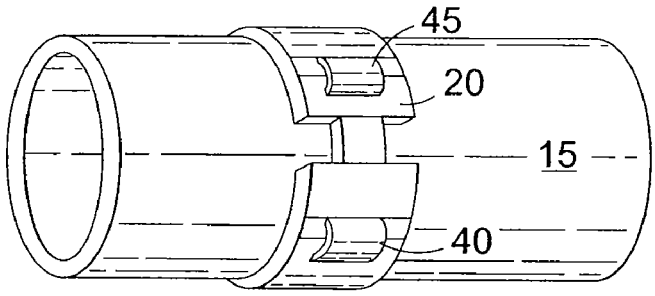
FIGS. 4(*a*) and (*b*) side and end views of the downhole assembly of FIGS. 1(*a*) to (*e*) before expansion.
Figure 4B:
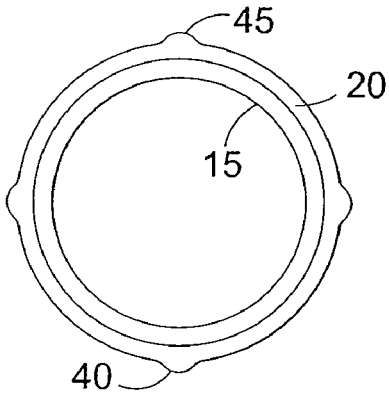
Figure 5A:
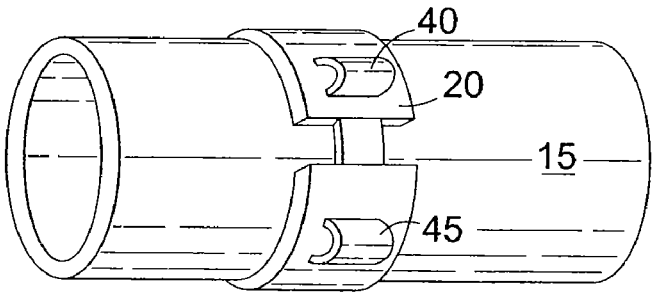
FIGS. 5(*a*) and (*b*) side and end views of the downhole assembly of FIGS. 1(*a*) to (*e*) after expansion.
Figure 5B:
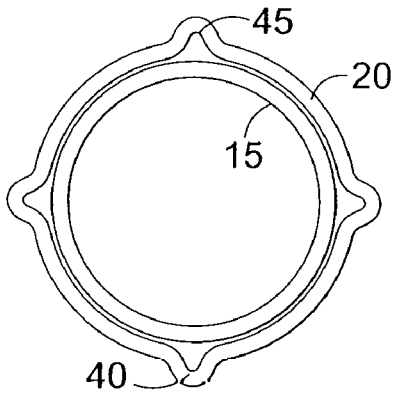

As can be seen from FIGS. 4(*a*) to 5(*b*) a plurality of first and second members 30,35;130,135;230,235;330,335 and portions 40;140;240;340 are provided around a circumference of the expandable centralisers 40;140;240;340.

Radial contraction or removal of the expanded tubular 10 can optionally cause radial contraction of the or each at least one portion 40;140;240;340. In this way the expandable centraliser may be expandable and contractible.

The expandable centralisers 20;120;220;320 are at least partly made from a polymeric material or plastic material, or beneficially, from a metal or metallic based material such as steel.

The polymeric or plastics material or plastics material is selected from a polymeric material, a plastic material, or beneficially a thermoplastic elastomer (TPE), e.g. a styrene block copolymer, polyolefin blend, elastomer alloys, thermoplastic polyurethane, thermoplastic polyamide.

For each expandable centraliser 20;120;220;320 in use, radial expansion of the centraliser 20;120;220;320 causes compression of at least one portion 40;140;240;340 of the centraliser so as to radially expand said at least one portion 40;140;240;340.

Said at least one portion 40;140;240;340 comprises a blade of the expandable centraliser 20;120;220;320.

Referring again to FIGS. 1(*a*) to (*e*) the invention provides the downhole assembly or apparatus 10 comprising at least one expandable tubular 15 and at least one expandable centraliser 20 or 120 or 220 or 320.

In a preferred embodiment the at least one expandable tubular 15 comprises casing. Alternatively, in a modified embodiment the at least one expandable tubular can comprise a liner, or a screen. Alternatively, in a further modified embodiment the at least one expandable tubular comprises a production tubing.

An explanation of the difference between casing, liners, screens and production tubing is given in WO 99/25949 (BRUNEL) and WO 02/02904 (BRUNEL), the content of which is incorporated herein by reference.

The at least one expandable centraliser 20;120;220;320 is mounted on the at least one expandable tubular 15 so as to circumferentially surround the expandable tubular 15.

In use, the invention provides a method of centralising the expandable tubular 15 within borehole or wellbore 5 comprising the step of:

providing the at least one expandable tubular 15 and at least one expandable centraliser 20;120;220;320, wherein the expandable centraliser 20;120;220;320 comprises a centraliser according to any of the first to fourth embodiments hereinbefore described.

The method also comprises the further step of:

placing the at least one expandable tubular 15 and the at least one expandable centraliser 20;120;220;320 within the wellbore 5.

The method further comprises the yet further step of:

expanding the tubular 15, e.g. using a tubular expander 70 either pushed down the tubular 15 or pulled up the tubular 15, thereby causing expansion of the expandable tubular and expandable centraliser 20;120;220;320 or blades 40;140;240;340.

It will be appreciated that the embodiments of the invention hereinbefore described are given by way of example only and are not intended to limit the scope of the invention in any way. For example, the disclosed centralisers 20;120;220;320 are adapted to be used in conjunction with expandable casing and the centraliser 20;120;220;320 expands with the casing when an expander cone 70 is driven through the casing. This expanding motion causes a body of the centraliser to expand as well as causing blades of the centraliser to energise by a pre-determined amount thus giving the desired stand-off. It will however be appreciated that although the invention is particularly beneficial for use with expandable casing, the invention may find use with any expandable tubulars requiring to be centralised.

The invention claimed is:

1. An expandable centraliser comprising at least one first member and at least one second member, wherein, at least part of the at least first member and at least part of the at least second member longitudinally coincide, and wherein, in use, relative circumferential motion of the at least part of the at least one first member and the at least part of the at least one second member towards one another causes radial motion of at least one portion of the expandable centraliser.

2. An expandable centraliser as claimed in claim 1, wherein the circumferential motion is caused, in use, by radial expansion of the expandable centraliser, and the radial motion of the at least one portion is radial expansion thereof.

3. An expandable centraliser as claimed in claim 1, wherein the or each at least one first member comprises a finger or tongue, a distal end of which is fixed to the or a respective at least one second member.

4. An expandable centraliser as claimed in claim 3, wherein, in use, relative circumferential motion caused by radial expansion of a tubular causes the finger to bend or bow radially outwards.

5. An expandable centraliser as claimed in claim 1, wherein the or each at least one first member comprises a finger or tongue, and the or a respective at least second member comprises a ramp, wedge, or dog.

6. An expandable centraliser as claimed in claim 5, wherein, in use, relative circumferential motion caused by radial expansion of a tubular causes the finger to ride over the wedge so causing the finger to move radially outwards.

7. An expandable centraliser as claimed in claim 5, wherein the expandable centraliser is adjustable or tunable for a particular use by appropriate selection of a length of the finger or tongue so as to provide a pre-selected radial expansion of the at least one portion.

8. An expandable centraliser as claimed in claim 1, wherein the at least one portion comprises at least one elastomeric bush.

9. An expandable centraliser as claimed in claim 8, wherein, in use, circumferential motion caused by radial expansion of a tubular causes the bush to be compressed or squeezed between the respective first and second members.

10. An expandable centraliser as claimed in claim 8, wherein the bush is made from a material selected from the group consisting of a polymeric material, a plastics material, a thermoplastic elastomer (TPE), a styrene block copolymer, polyolefin blend, elastomeric alloy, thermoplastic polyurethane, and thermoplastic polyamide.

11. An expandable centraliser as claimed in claim 8, wherein the expandable centraliser is adjustable or tunable for a particular use by appropriate selection of a size, compressibility or size and compressibility of the bush so as to provide a pre-selected radial expansion of the at least one portion.

12. An expandable centraliser as claimed in claim 1, wherein the expandable centraliser is adjustable or tunable for a particular use by appropriate selection, so as to provide a pre-selected radial expansion of the at least one portion.

13. An expandable centraliser as claimed in claim 1, wherein each at least one portion, in use, acts as a blade of the expandable centraliser touching the borehole or tubular within which an expandable tubular is to be centred.

14. An expandable centraliser as claimed in claim 1, wherein the expandable centraliser comprises a circular cross-section.

15. An expandable centraliser as claimed in claim 1, wherein the expandable centraliser is substantially annular or tubular in shape.

16. An expandable centraliser as claimed in claim 1, wherein a plurality of first and second members and portions are provided around a circumference of the expandable centraliser.

17. An expandable centraliser as claimed in claim 1, wherein, in use, radial contraction or removal of the expanded tubular causes radial contraction of an or each at least one portion.

18. An expandable centraliser as claimed in claim 1, wherein the centraliser is substantially or partly made from a metal or metallic based material.

19. An expandable centraliser as claimed in claim 18, wherein the centraliser is made partly from a metal or metallic based material and partly from a polymer or plastics material.

20. An expandable centraliser as claimed in claim 18, wherein the metal or metal based material is steel.

21. An expandable centraliser as claimed in claim 1, wherein the centraliser is substantially or partly made from a polymer or plastics material.

22. An expandable centraliser as claimed in claim 21, wherein the polymer or plastics material is a thermoplastic, polyetheretherketone, polyphthalamide, or polyamide.

23. An expandable centraliser as claimed in claim 1, wherein, in use, radial expansion of the centraliser causes movement of said at least one portion of the centraliser so as to radially expand said at least one portion, wherein the movement is selected from the group consisting of compressive movement, and compressive and circumferential movement.

24. An expandable centraliser as claimed in claim 23, wherein said at least one portion comprises a blade of the expandable centraliser.

25. An expandable centraliser according to claim 1, wherein the centraliser is selected from the group consisting of:

a casing centraliser;

a liner centraliser or screen centraliser; and a production tubing centraliser.

26. A downhole assembly or apparatus comprising at least one expandable tubular and at least one expandable centraliser according to claim 1.

27. A downhole assembly or apparatus as claimed in claim 26, wherein the assembly provides a plurality of expandable centralisers.

28. A downhole assembly or apparatus as claimed in claim 27, wherein the plurality of expandable centralisers are longitudinally spaced along a length of the expandable tubular.

29. A downhole assembly or apparatus as claimed in claim 26, wherein the at least one expandable tubular comprises casing.

30. A downhole assembly or apparatus as claimed claim 26, wherein the at least one expandable tubular comprises a liner, or a screen.

31. A downhole assembly or apparatus as claimed in claim 26, wherein the at least one expandable tubular comprises production tubing.

32. A downhole assembly or apparatus as claimed in claim 26, wherein the at least one expandable centraliser is mounted on the at least one expandable tubular so as to circumferentially surround the expandable tubular.

33. An expandable centraliser as claimed in claim 1, wherein at least in an expandable disposition of the centraliser the at least one first member and at least one second member are provided in abutting relation to one another.

34. An expandable centraliser as claimed in claim 1, wherein the at least part of the at least first member and the at least part of the at least second member are provided on a circumferential portion and are circumferentially adjacent or overlapping.

35. An expandable centraliser comprising a first part and a second part which longitudinally coincide along a length of the expandable centraliser, wherein, in use, relative circumferential motion of the first part and the second part towards one another causes radial expansion of one of the first or second parts.

36. An expandable centraliser as claimed in claim 35, wherein the expandable centraliser is made at least partly from a polymeric material or plastic material.

37. An expandable centraliser as claimed in claim 36, wherein the polymeric material or plastics material is selected from the group consisting of a polymeric material, a plastic material, a thermoplastic elastomer (TPE), a styrene block copolymer, polyolefin blend, elastomeric alloy, thermoplastic polyurethane, and thermoplastic polyamide.

38. A method of centralising an expandable tubular within a borehole comprising the step of:

providing at least one expandable tubular and at least one expandable centraliser, wherein the expandable centraliser comprises at least one first member and at least one second member, wherein, at least part of the at least one first member and at least part of the at least second member longitudinally coincide, and wherein, in use, relative circumferential motion of the at least part of the at least one first member and the at least part of the at least one second member towards one another causes radial motion of at least one portion of the expandable centraliser.

39. A method of centralising an expandable tubular within a borehole as claimed in claim 38, wherein the method comprises the further steps of:

mounting the expandable centraliser on the expandable tubular so as to provide an assembly;

placing the assembly in the borehole.

40. A method of centralising an expandable tubular within a borehole as claimed in claim 38, wherein the method comprises the further step of:

expanding the expandable tubular thereby causing expansion of the expandable tubular and expandable centraliser.

41. A method of centralising an expandable tubular within a borehole as claimed in claim 40, wherein the step of expanding the expandable tubular comprises using a tubular expander either pushed down the tubular or pulled up the tubular.

42. An expandable centraliser comprising at least one first member and at least one second member, wherein at least part of the at least first member and at least part of the at least second member longitudinally coincide and are provided on a circumferential portion, and wherein, in use, relative motion of the at least part of the at least one member and the at least part of the at least one second member around the circumferential portion towards one another causes compressive and radial motion of at least one portion of the expandable centraliser.

* * * * *